US008277084B2

(12) United States Patent
Hough et al.

(10) Patent No.: US 8,277,084 B2
(45) Date of Patent: Oct. 2, 2012

(54) MULTIPLE FOCUS POINT LIGHT

(75) Inventors: Thomas A. Hough, Tucson, AZ (US); James Bornhorst, DeSoto, TX (US)

(73) Assignee: Production Resource Group, LLC, New Windsor, NY (US)

( * ) Notice: Subject to any disclaimer, the term of this patent is extended or adjusted under 35 U.S.C. 154(b) by 0 days.

(21) Appl. No.: 13/302,082

(22) Filed: Nov. 22, 2011

(65) Prior Publication Data

US 2012/0069573 A1 Mar. 22, 2012

Related U.S. Application Data

(60) Continuation of application No. 12/787,337, filed on May 25, 2010, now Pat. No. 8,061,873, which is a division of application No. 11/687,579, filed on Mar. 16, 2007, now Pat. No. 7,726,843.

(60) Provisional application No. 60/783,636, filed on Mar. 17, 2006, provisional application No. 60/864,125, filed on Nov. 2, 2006.

(51) Int. Cl.
*F21S 8/00* (2006.01)
*F21V 9/00* (2006.01)

(52) U.S. Cl. ..... 362/268; 362/293

(58) Field of Classification Search ..... 362/268, 362/277, 293, 319, 331
See application file for complete search history.

(56) References Cited

U.S. PATENT DOCUMENTS

| | | | | |
|---|---|---|---|---|
| 5,416,681 | A * | 5/1995 | Wu | 362/284 |
| 5,806,951 | A * | 9/1998 | Roman et al. | 353/84 |
| 6,081,383 | A * | 6/2000 | Tannemyr et al. | 359/634 |
| 6,817,737 | B2 * | 11/2004 | Romano et al. | 362/293 |
| 7,004,604 | B2 * | 2/2006 | Ohmae et al. | 362/268 |
| 7,290,907 | B2 * | 11/2007 | Kovach | 362/512 |
| 7,600,891 | B2 * | 10/2009 | Belliveau et al. | 362/231 |

* cited by examiner

*Primary Examiner* — David Crowe
(74) *Attorney, Agent, or Firm* — Law Office of Scott C. Harris, Inc.

(57) ABSTRACT

A lamp unit with a relay lens that allows two different focus points. Two different optical altering elements are hence simultaneously in focus. The elements can be taken in and out of focus to allow different effects.

12 Claims, 3 Drawing Sheets

MULTIPLE FOCUS POINT LIGHT

CROSS-REFERENCE TO RELATED APPLICATIONS

This is continuation application of U.S. Ser. No. 12/787,337 filed May 25, 2010, now U.S. Pat. No. 8,061,873 issued Nov. 22, 2011, which is a divisional of U.S. application Ser. No. 11/687,579, filed Mar. 16, 2007, now U.S. Pat. No. 7,726,843 issued Jun. 1, 2010, which claims priority to U.S. Provisional Application Ser. Nos. 60/783,636, filed Mar. 17, 2006 and 60/864,125, filed Nov. 2, 2006. The disclosure of the prior applications are considered part of (and are incorporated by reference in) the disclosure of this application.

BACKGROUND

Stage lights often allow different kinds of features and effects to be projected onto a stage a typical stage light might be a pan and tilt controllable device, which is remotely controllable over a format such as DMX, and produces a beam with an output intensity of at least 150 W, but more preferably between 400 and 800 W.

Many such devices also allow very sophisticated effects, such as gobos, coloration, blurring, and other similar effects. Many of these effects may depend on whether the item used to adjust the light control is in or out of focus at a specific location.

Most stage lights have only a single focus location.

SUMMARY

The present application describes a stage light with multiple focus points and effects items at these focus points. Embodiments describe various kinds of effects to be carried out.

BRIEF DESCRIPTION OF THE DRAWINGS

These and other aspects will now be described in detail with reference the accompanying drawings, wherein.

DETAILED DESCRIPTION

The general structure and techniques, and more specific embodiments which can be used to effect different ways of carrying out the more general goals, are described herein.

The present application describes a multiple focus point light, which has multiple image planes, and a relay lens to allow relaying an image from image plane 1 into image plane 2.

Figure 1:
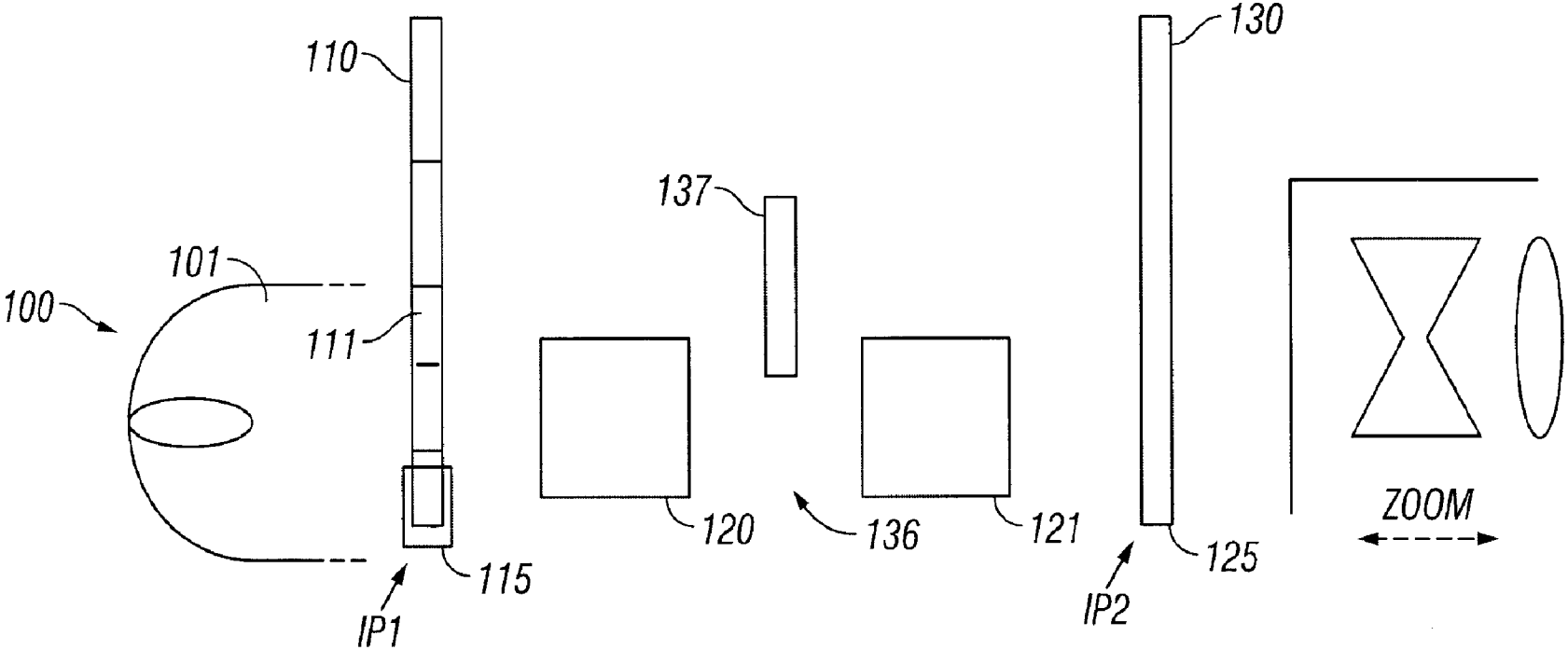
FIG. 1 shows an embodiment of the multiple focus point light.

FIG. 1 shows an embodiment of the overall light projection system. A lamp 100, which is preferably 200 W or more, produces an output beam of light shown as 101. A rotating gobo 110 is placed within the beam of light, such that an effective portion of the gobo, which may be the part 111 of the gobo that shapes the light, is within the optical train formed from the beam of light. The rotating gobo is located at image plane 1 shown as IP1, area 115.

A movable relay lens 120 is adjacent to the image plane 1, and receives the image from image plane 1. The relay lens relays the image from image plane 1 to a second image plane shown as image plane 2 125. The relay lens parts 120, 121 however, are movable/adjustable so that different effects are possible.

Another optical element is located in the image plane 2. FIG. 1 shows color wheel 130 at that location. Therefore, the focus point of image plane 2 receives the color wheel at that exact location. This completely spreads the image over a desired area.

By relaying the image from one image plane to another image plane, different items located at the different image planes can be projected as though they were precisely on top of one another. Two different gobos can be used, for example, at the two different image planes, with both gobos being sharply in focus. A color wheel can be sharply in focus at the same as the gobo. Previous systems which used two gobos required one of the two gobos to be out of focus. This system allows both gobos to be in focus.

More generally, in a two-image plane system such as this one, any two optical elements can be simultaneously in focus. Elements can include coloration device, filters, lenses, blurs, effects, gobos, or any other element that changes any projected aspect of the light.

The area 136 between the two portions of the relay lens 120, 121 is called the optical stop. Any optical effect, e.g. gobos, color wheel, lens, filters such as blurs or effects, that is in the optical stop pattern becomes substantially perfectly integrated in the projected image. Therefore, different effects can be obtained by putting items such as color filters and the like in the optical stop 136. FIG. 1 shows a color wheel 137 in the optical stop, but it should be understood that other effects can be placed therein. Multiple effects can be used in the stop.

Figure 2:
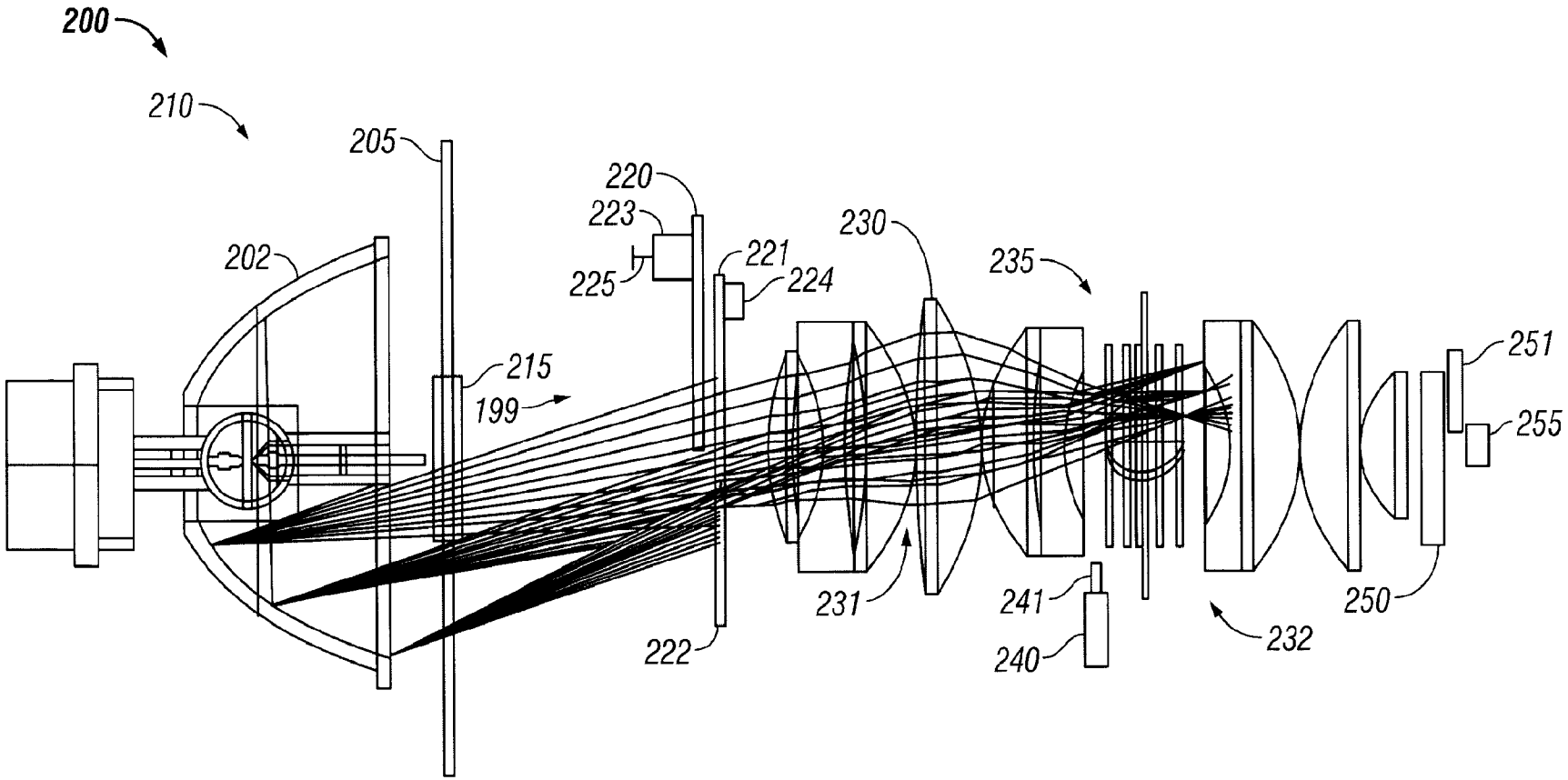
FIG. 2 shows another embodiment which includes multiple structures and includes moving parts for those structures.

FIG. 2 illustrates an alternative embodiment. 200 represents an optical beam producing part producing a light beam along a path which can include a bulb and reflector assembly. For example, this may use an 1100 Watt bulb and a spherical or parabolic reflector 202. In the embodiment, a heat blocking device 205 serves to form a hot chamber in the area 210 behind the blocking part. The heat blocking portion 205 may include a wall of metal such as aluminum, with an opening area 215 formed of a UV/IR filter with areas that allow angles relative to the direction 199 of the optical beam to pass. The UV/IR filter 215 reflects ultraviolet and infrared, and passes a beam of light which is as cooled as possible.

First and second light altering devices 220, 221 are located at the focused location 222 of the reflector 202. The relay lens parts such as 230 are associated with a moving part that allows them to be moved along the optical train. The moving parts allow the relay lens parts to be moved in the direction 225, substantially parallel to the direction of the optical train 199. The movement is done to allow either of the devices 220, 221 to be at exactly a focus point of the relay lens, or out of the point of image of the relay lens. In the embodiment, one of the devices is brought into focus, while the other is brought out of focus.

The light changing devices 220, 221 can be gobos or color changers, for example.

A relay lens 230 is formed of first and second parts 231, 232, with an optical stop 235 in between those first and second parts. A solenoid actuator 240 allows an optical part 241 to be selectively placed partially or completely within the stop between the relay lens parts. Anything placed in that stop is automatically integrated into the resultant light beam.

Therefore, placing the optical part 241 one quarter into the stop causes a ¼ effect of the part. For example, a coloration device will cause ¼ its overall coloration, and a light blocking device will cause ¼ intensity dimming.

As described above, the relay lens enables a second point of focus, and the second optical altering device 250, here a gobo wheel, is placed precisely in the second image plane of the relay lens. There may be an additional optical altering device 251, located so that there are two optical altering devices in each focus location. These may also be movable.

An objective lens 255 may be a zoom lens, which allows focusing on one or both of the optical altering devices at either of the focus locations.

The purpose of the movement capability is to allow one of the two optical altering devices to be placed exactly at the focus location. The other optical altering device may be placed in its open location, that is so that there is simply an open hole, or may be used as an out-of-focus effect.

Figure 4:
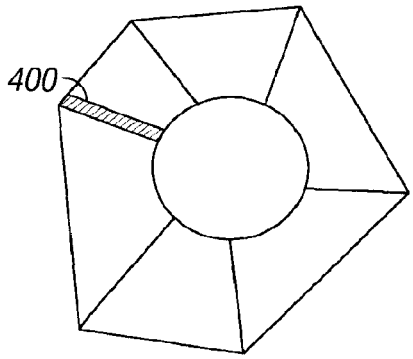
FIG. 4 shows a special light altering wheel for such device.

The coloration may include additional devices and out-of-focus locations after the cold mirror 205. Four separate color wheels can be used in the system, a three color wheel additive system formed of a cyan color wheel, a magenta color wheel and a yellow color wheel, and also a custom color wheel, are shown in detail in FIG. 4. The custom color wheel may allow replacement of color lenses, for example, so that each of a plurality of different colors become possible. The color wheel also includes a ⅛-¼ inch black line 400 between two adjacent colors. This allows the projection of split color on the screen. For example, since this may be used at an out-of-focus location, the black line will not be visible in the final image; but rather only a split color effect will be seen.

The gobo wheels may be etched gobo wheels, or may be images that are printed using a halftone technique. In operation, with a system, a number of effects become possible. Two different forms of coloration are possible, one in a relatively in-focus position, formed of custom colors, and the other, formed of an additive or subtractive three color wheel system in out-of-focus locations which are effectively integrated by the optical system. In addition, the two gobos may be halftone gobos, formed at a dot pitch, for example, of 300 dots per inch. Both gobos can be precisely in focus at the same time. It was found that when two gobos are in focus that the same time, something which has never been possible in any previous light, that interference or "moire" effects start to occur. The interference effects may produce a rainbow light effect from the imaging. Additional aliasing effects may also be possible. The aliasing changes may be enhanced when the gobos are rotated relative to one another.

It was found that when the two gobos are both precisely in focus, then the moire effect occurs based on the halftone patterns of the gobos causing aliasing between the two patterns of the gobos. The moire effect is caused when both gobos are exactly in focus at the same time, and both have the same printing characteristic. Circles and patterns can be used to emphasize the effect, as well as a third gobo wheel.

Another effect is caused by defocusing one of the two gobo images. Then, zoom lens 255 may be moved back and forth to focus and defocus the images which are in the image plane.

Any time that an additional optical element is brought into the system, the different parts may need to be moved slightly to maintain focus. Therefore, when one of the pieces is in its transparent or open position, a different focus position of the different parts is necessary then when it is in the other position. A refocusing to maintain the focus becomes necessary.

The actuator 240 may move, for example, a piece of frosted glass, or other kind of blurry integrator into the stop, to add that effect to the system. Again, by moving the effect material halfway into the stop, the effect is only seen halved. The position of the effect material is never seen, only its effect.

Figure 3:
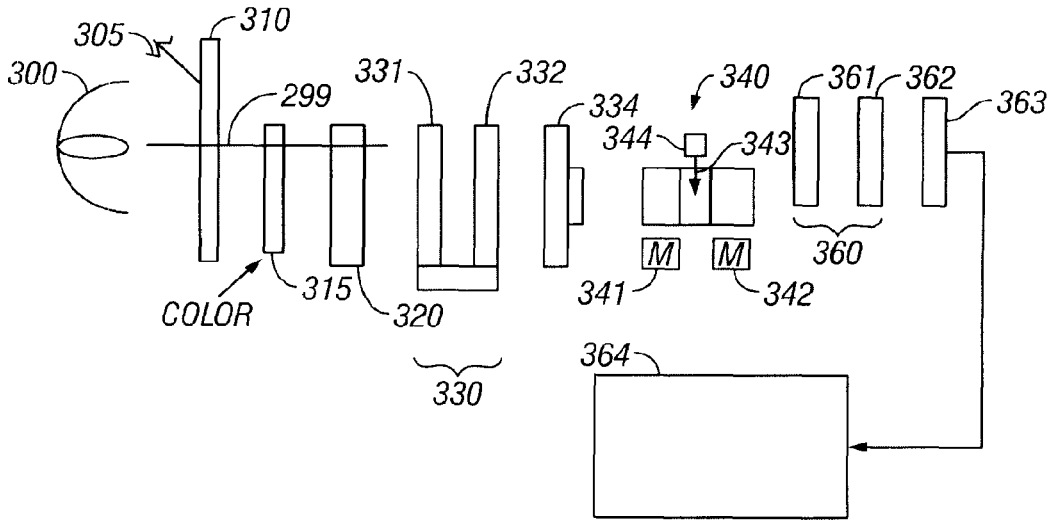
FIG. 3 shows another embodiment with additional structures including multiple color wheels and irises and a controller.

Another embodiment, shown in FIG. 3, shows an entire optical train with a relay lens system. A lamp 300 is initially producing light along an optical axis 299, through a UV/IR filter 310 that reflects infrared 305. A rotatable color wheel 315 and a dimmer wheel 320 are placed in series with the optical beam 299. These devices are at an out-of-focus location. A first in-focus location at 330 includes a first gobo wheel 331, and a first color wheel 332. As in the FIG. 2 embodiment, the relay lens parts can move to change the focus position to allow one or the other of the devices to be placed in focus.

A beam size iris 334 may be used to crop down the gobo to a reduced size. The beam size iris 334 is maintained in an out-of-focus location. The relay lens 340 is also located on a motorized part, with the first lens part 341 located on a motorized part 341 and the second lens part located on a second motorized part 342. At the second optical stop 360, a second gobo wheel 361 is located, along with other color wheels 362, 363.

The final image is directed through a zoom lens 364 which allows zooming the final image.

Figure 5:
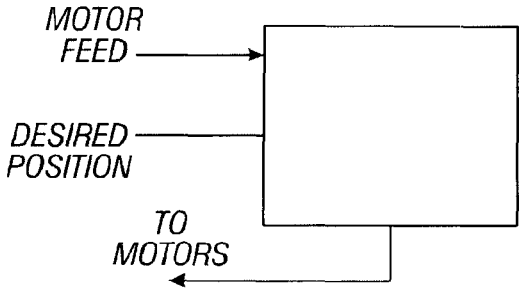
FIG. 5 shows a motor controlling chip.

The positions of the lenses may be controlled using brushless DC servo motors, and using a chipset which controls based on the motor feedback and the desired position, the operation of the servo motors. FIG. 5 illustrates a chipset that can be used to drive the brushless DC servo motors, where the chip receives motor feedback through one input, and an indication of the desired position through another input and produces an output that controls the position of the motor.

As in the FIG. 2 embodiment, the stop 343 within the relay lens 340 can include an articulated arm 344 to push an external device in and out of the stop. Anything within the stop automatically gets integrated into the light beam. Therefore, the item can be a piece of frosted glass, or a blocking part that blocks light, or a coloration part. The part is pushed in and out of the light beam by an articulated arm 344. This changes the look of the projected image and since it is in the stop, it automatically integrates the entire stop within the image.

The entire unit can be remotely controllable via a remote console, over four example DMX, arcnet, or any other remotely controllable protocol.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other effects beyond gobo wheels and colors can be used. For example, while the above shows all of the optical elements arranged along a straight line, it should be understood that mirrors can be used to shorten the overall length of the optical element by adjusting the direction of the light movement. Other optical elements besides those specifically mentioned herein can be used. In addition, more complex relay lenses can be used to allow multiple different focus points. Also, the optical altering elements themselves, such as the zoom lens can be moved, instead of moving the relay lens, to bring the parts into focus.

The computers described herein may be any kind of computer, either general purpose, or some specific purpose computer such as a workstation. The computer may be a Pentium class computer, running Windows XP or Linux, or may be a Macintosh computer. The programs may be written in C, or Java, or any other programming language. The programs may be resident on a storage medium, e.g., magnetic or optical, e.g. the computer hard drive, a removable disk or other removable medium. The programs may also be run over a network, for example, with a server or other machine sending signals to the local machine, which allows the local machine to carry out the operations described herein.

Also, the inventors intend that only those claims which use the words "means for" are intended to be interpreted under 35 USC 112, sixth paragraph. Moreover, no limitations from the specification are intended to be read into any claims, unless those limitations are expressly included in the claims.

What is claimed is:

1. A lighting device comprising:

a light source forming light;

a lens system, having movable parts, said movable parts moving to define both in focus and out of focus locations of the lens, and defining first locations which can be brought into focus by said moving and also can be brought out of focus by said moving, and second locations which are always out of focus;

first and second optical elements, in a third path location to receive said light from said light source, both said first and second optical elements being in first locations which can be brought into focus, but where only one of said first and second optical elements can be in focus at any one time, said first and second optical elements being located between said lens and said light source;

third and fourth optical elements, located in a fourth path location, on an opposite side of said lens from said light source, and receiving light from said light source that has passed through said first and second optical elements, and where only one of said third and fourth optical elements can be in focus at any one time, but where one of said first and second optical elements can be in focus at the same time as one of said second and third optical elements;

at least one lens part moving motor, moving said movable parts of said lens to bring said optical elements into focus;

a fifth optical element at one of said second locations which is always out of focus; and at least a sixth optical element that is movable into and removable from an integration area that gets integrated into the light beam; and wherein said integration area is an area between said movable parts of said lens.

2. The lighting device as in claim 1, wherein said sixth optical element is a piece of frosted glass.

3. The lighting device as in claim 1, wherein said sixth optical element is a coloration item.

4. A device as in claim 1, wherein at least one of said first and second optical elements includes an etched gobo.

5. A device as in claim 1, wherein at least one of said first and second optical elements includes a halftone gobo.

6. A lighting device comprising:

a light source forming light;

a lens system, having movable parts, said movable parts moving to define both in focus and out of focus locations of the lens, and defining first locations which can be brought into focus by said moving and also can be brought out of focus by said moving, and second locations which are always out of focus;

first and second optical elements, in a third path location to receive said light from said light source, both said first and second optical elements being in first locations which can be brought into focus, but where only one of said first and second optical elements can be in focus at any one time, said first and second optical elements being located between said lens and said light source;

third and fourth optical elements, located in a fourth path location, on an opposite side of said lens from said light source, and receiving light from said light source that has passed through said first and second optical elements, and where only one of said third and fourth optical elements can be in focus at any one time, but where one of said first and second optical elements can be in focus at the same time as one of said second and third optical elements;

at least one lens part moving motor, moving said movable parts of said lens to bring said optical elements into focus; and a fifth optical element at one of said second locations which is always out of focus, wherein said first and third optical altering elements include halftone gobos formed with a same resolution.

7. A lighting device comprising:

a light source forming light;

a lens, having movable parts, said movable parts moving to define both in focus and out of focus locations of the lens, and defining first locations which can be brought into focus by said moving and also can be brought out of focus by said moving, and second locations which are always out of focus;

first and second optical elements, in a third path location to receive said light from said light source, both said first and second optical elements being in first locations which can be brought into focus, but where only one of said first and second optical elements can be in focus at any one time, said first and second optical elements being located between said lens and said light source;

third and fourth optical elements, located in a fourth path location, on an opposite side of said lens from said light source, and receiving light from said light source that has passed through said first and second optical elements, and where only one of said third and fourth optical elements can be in focus at any one time, but where one of said first and second optical elements can be in focus at the same time as one of said second and third optical elements;

at least one lens part moving motor, moving said movable parts of said lens to bring said optical elements into focus; and a controller, controlling said at least one lens part moving motor to bring one of said first and second optical elements into focus at the same time as one of said second and third optical elements;

at least another optical element that is movable into and removable from an integration area that gets integrated into the light beam;

wherein said integration area is an area between said movable parts of said lens.

8. A method of controlling production of light, comprising:

forming light using a light source;

moving movable parts of a lens system that has movable parts, said moving to defining both in focus and out of focus locations of the lens;

defining first locations which can be brought into focus by said moving and also can be brought out of focus by said moving, and second locations which are always out of focus;

locating first and second optical elements, in a first path location third path location to receive said light from said light source, both said first and second optical elements being in first locations which can be brought into focus, but where only one of said first and second optical elements can be in focus at any one time;

locating third and fourth optical elements, located in a fourth path location, on an opposite side of said lens from said light source, and receiving light from said light source that has passed through said first and second optical elements, and where only one of said third and fourth optical elements can be in focus at any one time, but where one of said first and second optical elements can be in focus at the same time as one of said second and third optical elements; and controlling said moving to bring one of said first and second optical elements into focus at the same time as one of said second and third optical elements.

9. A method as in claim 8, further comprising locating a fifth optical element at one of said second locations which is always out of focus.

10. The method as in claim 8, further comprising locating at least another optical element that is movable into and removable from an integration area that gets integrated into the light beam wherein said integration area is an area between said movable parts of said lens.

11. The method as in claim 10, wherein said another optical element is mounted on an arm that can be pushed in and out of said integration area.

12. The method as in claim 10, wherein said integration area is an area between said movable parts of said lens.

* * * * *